US007287680B2

(12) United States Patent
Déziel

(10) Patent No.: US 7,287,680 B2
(45) Date of Patent: Oct. 30, 2007

(54) NAILER WITH RATCHET-PROVIDED PLUNGER MECHANISM

(75) Inventor: André Déziel, St-Mathieu-du-Parc (CA)

(73) Assignee: Cresswell Industries Inc., Granby, Quebec (CA)

( * ) Notice: Subject to any disclaimer, the term of this patent is extended or adjusted under 35 U.S.C. 154(b) by 98 days.

(21) Appl. No.: 11/217,604

(22) Filed: Sep. 2, 2005

(65) Prior Publication Data

US 2007/0057013 A1 Mar. 15, 2007

(51) Int. Cl.

| | |
|---|---|
| ***B25C 1/00*** | (2006.01) |
| ***B25C 1/02*** | (2006.01) |
| ***B25C 5/10*** | (2006.01) |
| *B25C 1/18* | (2006.01) |

(52) U.S. Cl. ..... 227/110; 227/147; 227/148

(58) Field of Classification Search ..... 227/110, 227/134, 142, 147, 148, 149, 151; 173/31, 173/90, 121

See application file for complete search history.

(56) References Cited

U.S. PATENT DOCUMENTS

| | | | | |
|---|---|---|---|---|
| 2,285,384 A | | 6/1942 | Schott | |
| 2,768,376 A | | 10/1956 | Critchley | |
| 3,012,247 A | | 12/1961 | Sillars et al. | |
| 3,022,509 A | | 2/1962 | Tjark De Man | |
| 3,042,925 A | | 7/1962 | Frostad et al. | |
| 3,245,596 A | * | 4/1966 | Lygo | 227/116 |
| 3,281,046 A | * | 10/1966 | Boulay | 227/115 |
| 4,834,342 A | * | 5/1989 | Padgett | 227/147 |
| 6,318,620 B1 | | 11/2001 | Anstett et al. | |

* cited by examiner

*Primary Examiner*—Rinaldi I. Rada
*Assistant Examiner*—Nathaniel Chukwurah
(74) *Attorney, Agent, or Firm*—François Martineau

(57) ABSTRACT

A nailer for driving a fastener into a workpiece and comprising a main body defining a fastener ejection channel. A plunger is movably carried by the main body and defines a first end for receiving forceful mallet blows and a second end for engaging the fastener, the plunger also comprising a series of teeth and grooves and defining a longitudinal cavity extending between the first and second ends, the plunger being movable relative to the main body between a first limit position in which the plunger second end clears the fastener ejection channel, and a second limit position in which the plunger second end engages the fastener ejection channel. A stem member is carried by the nailer main body and penetrates the plunger longitudinal cavity, the stem member carrying a spring-loaded pawl capable of unidirectional releasable interlocking engagement with the teeth and grooves of the plunger. A plunger biasing member continuously biases the plunger towards the first limit position. Upon a forceful blow being applied to the plunger first end, the plunger will be forced from its first towards its second limit positions and if the plunger is forced to an intermediate position between its first and second limit positions, the pawl will engage in unidirectional releasable interlocking fashion in the teeth sand grooves of the plunger to retain the plunger in this intermediate position against the bias of the plunger biasing member whereby the plunger may be gradually moved with several forceful blows from the first to the second limit position without moving back towards its first limit position until it reaches the second limit position.

20 Claims, 8 Drawing Sheets

NAILER WITH RATCHET-PROVIDED PLUNGER MECHANISM

FIELD OF THE INVENTION

The present invention relates to fastener discharge mechanisms, and more particularly to a nailer for hardwood flooring having a ratchet-provided plunger mechanism allowing a user to strike multiple mallet blows on the plunger until the fastener has been driven completely into the workpiece.

BACKGROUND OF THE INVENTION

Hardwood flooring generally consists of a number of juxtaposed elongated tongue-and-groove planks interlocked with each other, and then fastened in position to a subjacent subfloor. To fasten these hardwood planks to the subfloor of a room (composed for example of plywood plates and/or floor joists), it is known to use hardwood flooring nailers. Such nailers can either be manually or pneumatically operated.

Manually-operated nailers generally comprise a main body with a floor-engageable sole mounted to its bottom surface, upon which the tool rests against a hardwood plank prior to discharging a fastener in the latter. These nailers also comprise a magazine containing a frangible strip of collated metallic fasteners, such as L- or T-shaped barbed cleats or U-shaped staples, fed to a fastener discharge mechanism. A plunger having an impact-receiving head member at an outer free end thereof is slidably mounted to and extends out of the nailer's main body, and a recoil spring biases the plunger away from the nailer's main body into its extracted position where it is extended out of the nailer's main body. The fastener discharge mechanism is activated when the plunger's head member is struck with a mallet to cause the plunger to slidably retract inside the nailer's main body to impact on a selected fastener of the fastener strip and drive this fastener out of the nailer and into the subjacent workpiece. The fastener is fully driven into the workpiece only if the plunger has been struck hard enough so as to have retracted inside the nailer's main body up to a determined retracted limit position.

After the plunger is struck, the recoil spring is used to resiliently bias the plunger head back to its initial extracted position.

In using the above described manual nailing machines, problems occur if the user does not strike the plunger with enough force to retract the plunger up to its retracted limit position in which the fastener is fully driven into the workpiece. For instance, to drive a partially driven fastener the rest of the way into the workpiece, the user must again apply enough force to the plunger head to recompress the recoil spring. Accordingly, recompressing the recoil spring several times over the course of a flooring job can cause the workman to become prematurely exhausted.

Furthermore, weaker users who are unable to retract the plunger all the way to its retracted limit position with a single mallet blow may not be able to use the nailer at all.

To remedy this problem, certain prior art nailers are provided with a ratchet mechanism holding the plunger in intermediate positions after it is struck with a mallet, until the plunger reaches its retracted limit position, at which point the ratchet mechanism is released and the recoil spring is allowed to urge the plunger back to its rest or neutral position. This feature gives the user the opportunity to strike multiple mallet blows on the plunger head member to gradually move towards the retracted limit position, in which the fastener has been driven completely into the workpiece. However, existing ratchet-provided nailers have been found to wear out or break too rapidly.

SUMMARY OF THE INVENTION

The present invention relates to a nailer for driving a fastener into a workpiece, comprising:

- a main body defining a fastener ejection channel for accommodating a fastener;
- a plunger movably carried by said main body and defining a first end for receiving forceful blows and a second end for engaging the fastener, said plunger carrying first ratchet means and defining a longitudinal cavity extending from said first end towards said second end, said plunger being movable relative to said main body between a first position in which said plunger second end clears said fastener ejection channel, and a second position in which said plunger second end engages said fastener ejection channel for ejecting the fastener from said nailer;
- a stem member carried by said main body and penetrating said plunger longitudinal cavity, said stem member carrying second ratchet means capable of unidirectional releasable interlocking engagement with said first ratchet means; and
- a plunger biasing member continuously biasing said plunger towards said first position;

wherein upon a forceful blow being applied to said plunger first end, said plunger will be forced from said first towards said second positions and wherein if said plunger is forced to an intermediate position between said first and said second positions, said first and second ratchet means will cooperate in unidirectional releasable interlocking fashion to retain said plunger in said intermediate position against the bias of said plunger biasing member whereby said plunger may be gradually moved with several forceful blows from said first to said second position without moving back towards its first position until it reaches said second position.

In one embodiment, said first ratchet means comprises sets of alternating teeth and grooves made on a peripheral wall of said plunger longitudinal cavity, and said second ratchet means is a spring-loaded pawl pivotally mounted to said stem member and having a pawl tip lockingly engageable in said grooves.

In one embodiment, said main body comprises an elongated plunger socket defining top and bottom walls and an elongated peripheral wall extending therebetween, said plunger socket having an opening at said top wall thereof, said plunger socket comprising a tubular liner extending from said socket bottom wall to said top wall about said socket opening, said plunger being slidably received in said liner, and said stem member being located within said liner and resting against said socket bottom wall.

In one embodiment, said stem member comprises a lumen in which an elongated pawl spring and a ball are coaxially nested, said pawl spring continuously biasing said ball towards said pawl in order for said pawl to be continuously biased towards a neutral position.

In one embodiment, said pawl is pivoted to a first pawl position when said plunger is moved from said first position to said second position and is located therebetween, and when said pawl is in said first pawl position, said pawl will cooperate with said teeth and said grooves in unidirectional releasable interlocking engagement to prevent said plunger to move towards said first position. In this embodiment, said plunger cavity peripheral wall comprises a first release clearance registering with said pawl tip when said plunger is in said second position, such that said pawl tip can partially extend into said first release clearance when said plunger is in said second position so as return from said first pawl position to a neutral position, to allow said plunger biasing member to urge said plunger towards said first position without hindrance from said pawl when said plunger reaches said second position.

In one embodiment, said first release clearance is a release notch made through said plunger cavity peripheral wall at a position intermediate said set of teeth and said plunger first end.

In one embodiment, said pawl is pivoted to a second pawl position when said plunger is moved from said second position to said first position and is located therebetween, and when said pawl is in said second pawl position, said pawl will cooperate with said teeth and grooves in unidirectional releasable interlocking engagement to prevent said plunger to move towards said second position. In this embodiment, said plunger cavity peripheral wall comprises a second release clearance registering with said pawl tip when said plunger is in said first position, such that said pawl tip partially extends into said second release clearance when said plunger is in said second position so as return from said second pawl position to said neutral position, to allow said plunger to be urged towards said second position without hindrance from said pawl when said plunger is in said first position.

In one embodiment, said second release clearance is a gap formed beyond said plunger second end.

In one embodiment, said main body further comprises a guide roller attached to said plunger socket and rollably engaging a guiding groove made on an outer surface of said plunger.

In one embodiment, said plunger further comprises a hammer blade at said second end, said hammer blade positioned so as to sweep said fastener ejection channel when said plunger is moved from said first to said second positions.

In one embodiment, said plunger biasing member is a spring linked to said plunger and said stem member.

The present invention also relates to a ratchet-provided plunger mechanism for installation on a nailer, comprising:

a plunger for movable attachment to the nailer main body and defining a first end for receiving forceful blows and a second end for engaging a fastener to be discharged by the nailer, said plunger carrying first ratchet means and defining a longitudinal cavity extending from said first end and towards said second end;

a stem member for installation on a main body of the nailer, said stem member carrying second ratchet means, wherein said second ratchet means are capable of unidirectional releasable interlocking engagement with said first ratchet means, said stem member penetrating said plunger longitudinal cavity, said plunger being telescopically movable relative to said stem member between a first position in which said plunger is telescopically extended away from said stem member for said plunger second end to clear a fastener ejection channel of the nailer main body, and a second position in which said plunger is telescopically retracted towards said stem member for said plunger second end to engage the fastener ejection channel; and a plunger biasing member for continuously biasing said plunger towards said first position;

wherein upon a forceful blow being applied to said plunger first end, said plunger will be forced from said first towards said second positions and wherein if said plunger is forced to an intermediate position between said first and said second positions, said first and second ratchet means will cooperate in unidirectional releasable interlocking fashion to retain said plunger in said intermediate position against the bias of said plunger biasing member whereby said plunger may be gradually moved with several forceful blows from said first to said second position without moving back towards its first position until it reaches said second position.

In one embodiment, said first ratchet means comprises sets of alternating teeth and grooves made on a peripheral wall of said plunger longitudinal cavity, and said second ratchet means is a spring-loaded pawl pivotally mounted to said stem member and having a pawl tip lockingly engageable in said grooves.

In one embodiment, said stem member comprises a lumen in which an elongated pawl spring and a ball are coaxially nested, said pawl spring continuously biasing said ball towards said pawl in order for said pawl to be continuously biased towards a neutral position.

In one embodiment, said pawl is pivoted to a first pawl position when said plunger is moved from said first position to said second position and is located therebetween, and when said pawl is in said first pawl position, said pawl will cooperate with said teeth and said grooves in unidirectional releasable interlocking engagement to prevent said plunger to move towards said first position. In this embodiment, said plunger cavity peripheral wall comprises a first release clearance registering with said pawl tip when said plunger is in said second position, such that said pawl tip can partially extend into said first release clearance when said plunger is in said second position so as return from said first pawl position to a neutral position, to allow said plunger biasing member to urge said plunger towards said first position without hindrance from said pawl when said plunger reaches said second position.

In one embodiment, said first release clearance is a release notch made through said plunger cavity peripheral wall at a position intermediate said set of teeth and said plunger first end. In one embodiment, said pawl is pivoted to a second pawl position when said plunger is moved from said second position to said first position and is located therebetween, and when said pawl is in said second pawl position, said pawl will cooperate with said teeth and grooves in unidirectional releasable interlocking engagement to prevent said plunger to move towards said second position. In this embodiment, said plunger cavity peripheral wall comprises a second release clearance registering with said pawl tip when said plunger is in said first position, such that said pawl tip partially extends into said second release clearance when said plunger is in said second position so as return from said second pawl position to said neutral position, to allow said plunger to be urged towards said second position without hindrance from said pawl when said plunger is in said first position.

In one embodiment, said second release clearance is a gap formed beyond said plunger second end.

In one embodiment, said plunger comprises a guiding groove made on an outer surface thereof for engagement by a guide roller carried by the nailer main body.

In one embodiment, said plunger further comprises a hammer blade at said second end, said hammer blade being for sweeping the fastener ejection channel of the nailer main body when said plunger is moved from said first to said second positions.

DETAILED DESCRIPTION OF THE EMBODIMENTS

Figure 1:
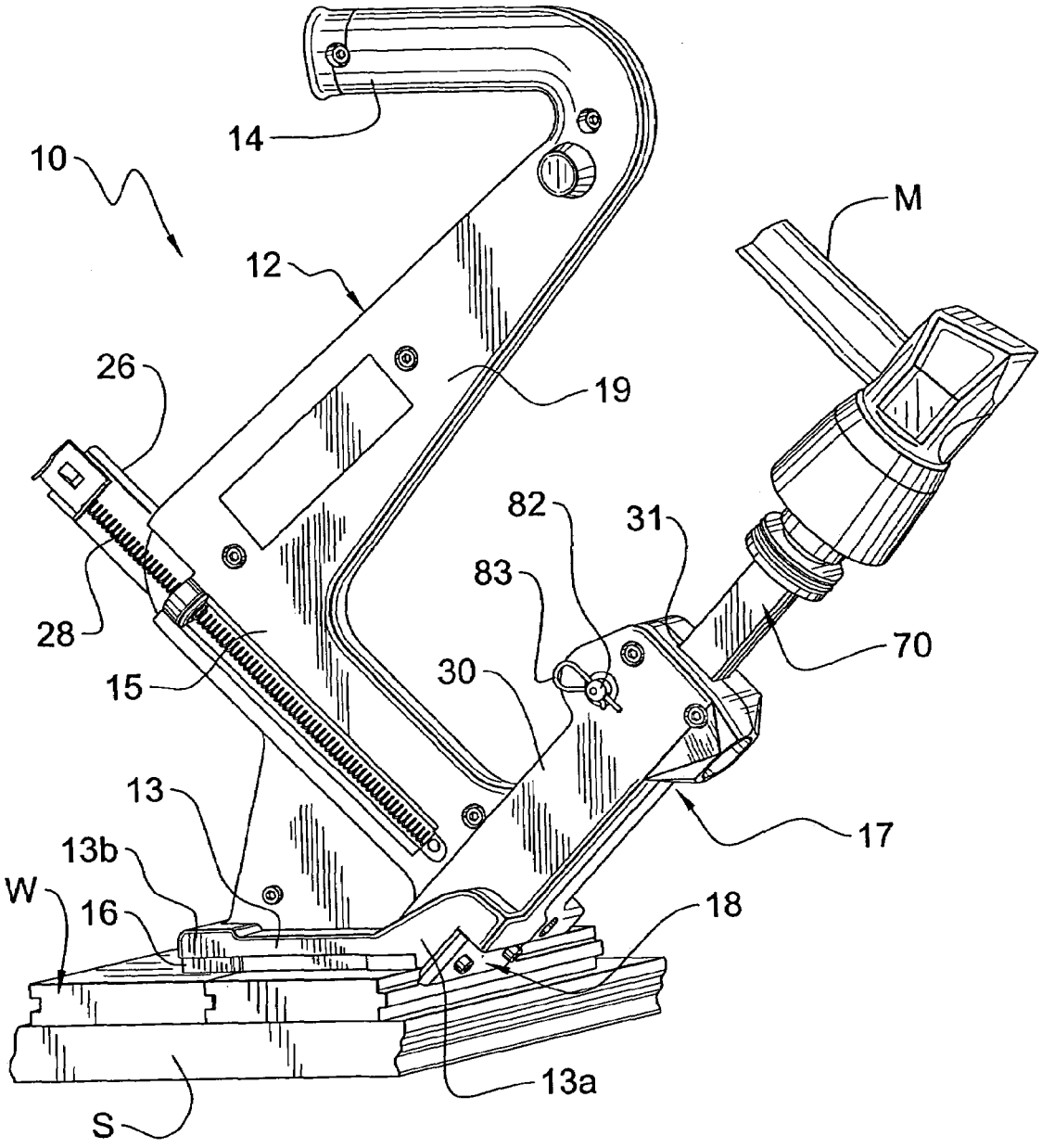
FIG. 1 is a front perspective view of a hardwood flooring nailer according to the present invention, sitting above a number of interlocked tongue-and-groove flooring workpieces which are in turn laid atop a subfloor.
Figure 2:
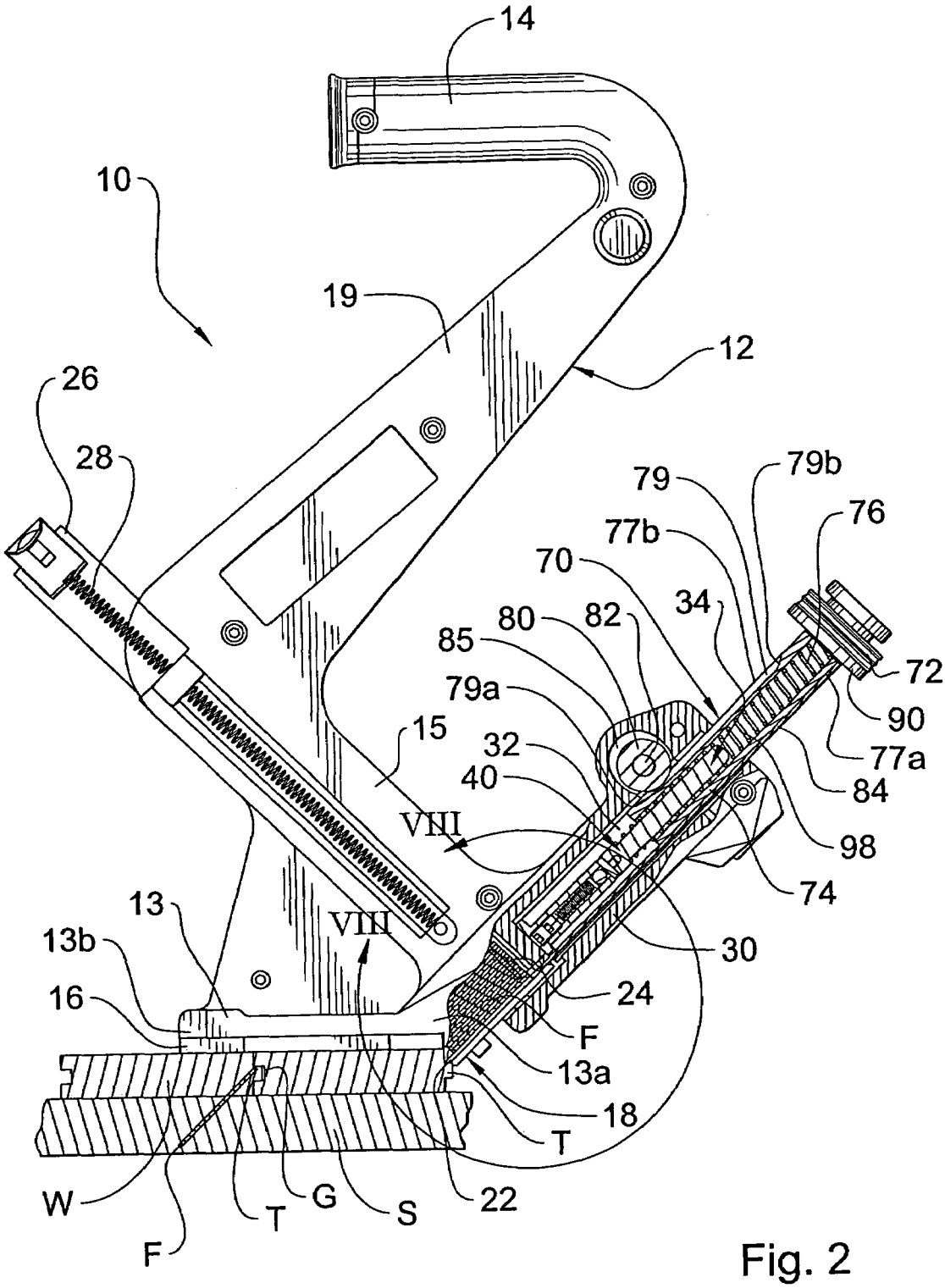
FIG. 2 is a side elevation of the nailer of FIG. 1, the plunger socket being partly broken for showing a cross-sectional view of the inside content thereof.

FIGS. 1-8 illustrate a nailer 10 provided with a ratchet mechanism (concealed in FIG. 1 but shown in FIGS. 2-6) for preventing the return of a partially driven plunger. Nailer 10 includes a main body 12 made of moulded cast aluminium for example.

Main body 12 comprises a shoe 13 destined to be horizontal when nailer 10 operatively sits on the ground, with shoe 13 defining opposite front and rear ends 13*a*, 13*b*; a magazine 15 extending upwardly away from the shoe front end 13*a* in an inclined fashion; a plunger mechanism 17 extending upwardly away from the shoe front end 13*a* and at a 90° angle from magazine 15; and a handle bar 19 extending away from magazine 15 and being elbowed so as to define a handle 14 which is, as shown, preferably parallel to shoe 13.

A planar sole 16 is mounted to the shoe 13 of main body 12, parallel thereto. During use of nailer 10, sole 16 sits on the upper surface of a flooring workpiece W which is in turn laid above a subfloor S. Main body 12 also comprises an ejection cap 18 at the shoe front end 13*a* including an inner plate 18*a* and an outer plate 18*b* (best shown in FIG. 8), made of a very rigid material such as tempered steel, superimposed and attached to each other. Ejection cap 18 is attached to main body shoe 13, adjacently to sole 16, so as to be arranged obliquely, for example at 45° with respect to the horizontal direction. A bottom edge portion of ejection cap 18 protrudes downwardly beyond the undersurface of sole 16; this downward projection portion will be referred to as nose 23.

Figure 8:
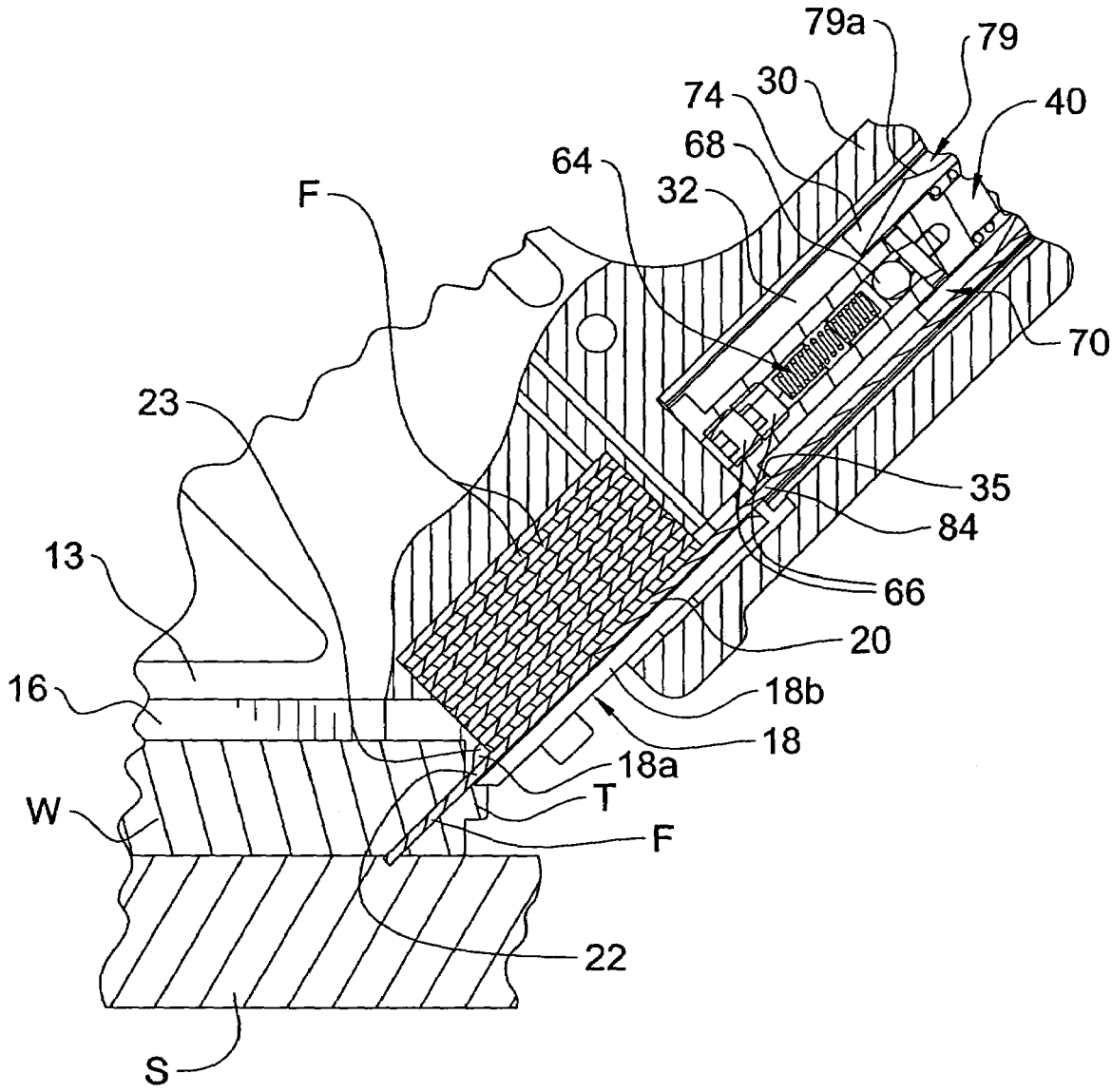
FIG. 8 is an enlarged view of the area circumscribed within circular line VIII-VIII of FIG. 2.

Inner plate 18*a* defines a bottom edge near sole 16 and an opposite top edge, and comprises a groove extending from its top edge to its bottom edge that forms a fastener ejection channel 20 (FIG. 8). Fastener ejection channel 20 opens outwardly of plate 18 at a fastener ejection opening 22 situated at the tip of nose 23.

Main body 12 further defines a magazine chamber 24 in magazine 15 in the form of an elongated channel, which is intended to accommodate fasteners F, for example a strip of collated L- or T-shaped cleats or U-shaped staples. Magazine chamber 24 communicates and is aligned with fastener ejection channel 20 of ejection cap 18. Furthermore, a feeder bar 26 (FIGS. 1-2) is inserted in magazine chamber 24, and a magazine spring 28 is attached to and tensioned between feeder bar 26 and nailer main body 12. When fasteners F are loaded within magazine chamber 24, magazine spring 28 pulls feeder bar 26 into pressing engagement against the last fastener fed into magazine chamber 24. This forces the fasteners F to be serially admitted into the fastener ejection channel 20, prior to being successively discharged out of nailer 10 through fastener ejection opening 22 at the tip of nose 23, driven through the subjacent workpiece W and into the underlying subfloor S.

Plunger mechanism 17 defines an elongated hollow plunger socket 30 extending frontwardly obliquely of nailer 10, in alignment with the front end of magazine chamber 24 and perpendicular to magazine 15. Plunger socket 30 comprises a longitudinal central cavity 32 of rectangular cross-section, which defines opposite top and bottom walls 33*a*, 33*b* and a peripheral wall 29. Top wall 33*a* has a rectangular recess 31*a* within which a smaller rectangular opening 31 is made, and bottom wall 33*b* has a rectangular recess 34 that is aligned and registers with top wall recess 31*a*. A stationary cross-sectionally rectangular tubular liner 36—made of tempered steel for example—snugly sits within and extends between top and bottom recesses 31*a* and 34 of plunger socket 30. A blade opening 35 (FIG. 8) is made in main body 12, which extends from the bottom wall of recess 34 in longitudinal cavity 32 to magazine chamber 24 in alignment with fastener ejection channel 20.

Figure 7:
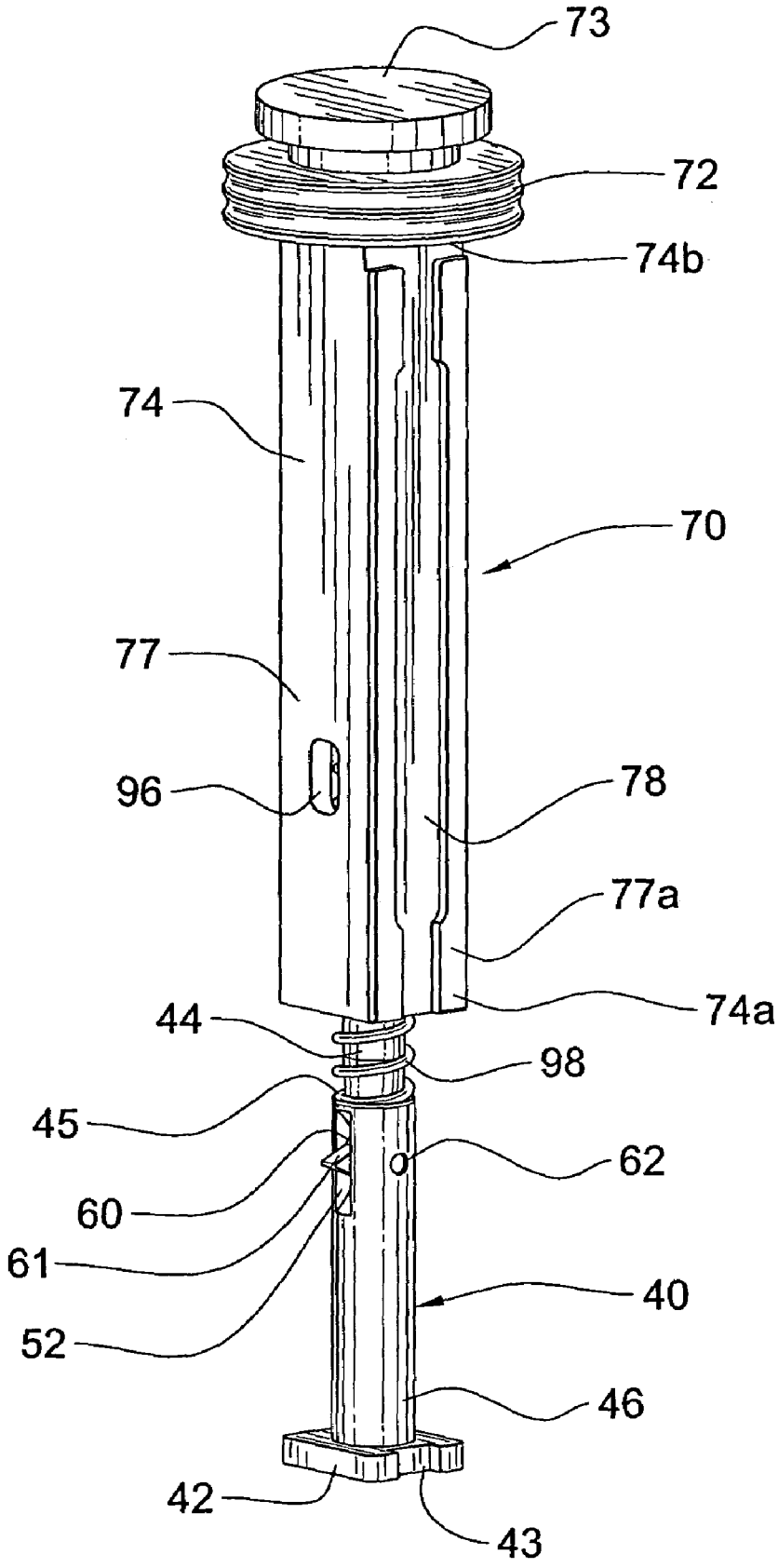
FIG. 7 is a front perspective view of the plunger slipped around the stem lodged within the plunger socket of the nailer.

Plunger mechanism 17 comprises an elongated stem member 40, illustrated in FIG. 7, which abuts against socket cavity bottom wall 33*b*, in the recess 34 thereof, so as to be confined within tubular liner 36; stem member 40 is coaxial with elongated liner 36. Stem member 40 can be made from a very rigid material such as tempered steel. Stem member 40 defines a foot member 42 bearing upon the bottom wall of recess 34 of socket cavity 32, with foot member 42 defining an indentation 43 registering with blade opening 35. A tubular sleeve portion 46 extends upwardly from foot member 42, and a spring post portion 44 extends upwardly in turn from sleeve portion 46, coaxially therewith. A shoulder 45 is formed at the junction between sleeve portion 46 and the relatively narrower spring post portion 44.

Sleeve portion 46 defines an elongated lumen 48 which opens outwardly of stem 40 at a bottom opening 50 traversing foot member 42, lumen 48 opening also at its opposite end into two diametrically opposite pawl windows 52 made through the peripheral wall of tubular sleeve portion 46, in the vicinity of shoulder 45.

Stem member 40 carries first ratchet means in the form of a spring-loaded pawl mechanism nested within its tubular sleeve portion 46. More particularly, a pivot pin 62, friction fitted at both ends into corresponding holes made in the peripheral wall of sleeve portion 46, pivotally carries a pawl 60 such that the latter is held within sleeve lumen 48 with only a radially projecting pawl tip 61 thereof sticking out of sleeve portion 46 through one of windows 52. Apart of pawl tip 61, pawl 60 is substantially cylindrical, although it defines a flattened rocking surface 60*a* that is angularly offset of 90° relative to pawl tip 61.

Biasing means are also provided to bias pawl 60 towards a neutral position (as detailed herein after); more particularly, a spring member 64 is forcibly compressed between a ball 68 nested in lumen 48 adjacent pawl 60 and a pair of set screws 66 threadingly engaging the bottom end portion of sleeve lumen 48—i.e. the end portion of sleeve lumen 48 adjacent bottom opening 50. Spring member 64 continuously biases ball 68 towards and against pawl 60. Since the pivot pin 62 carrying the pawl 60 is centered within lumen 48, and since the lower rocking surface 60*a* of pawl 60 that is engaged by ball 68 is only slightly convex, if not substantially flat, the spring biased engagement of ball 68 against pawl 60 will result in pawl 60 being continuously biased towards the neutral position shown in FIGS. 3 and 5, wherein pawl tip 61 extends at a right angle relative to the longitudinal axis of lumen 48 and stem member 40. Indeed, in this neutral position of pawl 60, since the spring-biased ball 68 engages the pawl rocking surface 60*a* at a right angle relative thereto and in an aligned fashion relative to the pawl pivot pin 62, pawl 60 is not subjected to any off-centered moment of force from the spring-biased ball 68. However, if pawl 60 is forced away from this neutral position against the spring biased action of ball 68 (FIGS. 4 and 6), then the spring-biased engagement of ball 68 on the pawl rocking surface 60*a* will be off-centered relative to the pawl pivot axis 62, creating a moment of force on pawl 60 that will force pawl 60 towards its neutral position.

It is noted that the position of set screws 60 can be adjusted along sleeve lumen 48, in order to adjust the tension in spring member 64. This allows adjustment of the biasing force applied by spring member 64 on ball 68 and thus on pawl 60.

Plunger mechanism 17 further comprises a plunger 70, made of a rigid material such as tempered steel, that is also received in the plunger socket 30 of the nailer's main body 12. Plunger 70 has a shank portion 74 defining distal and proximal ends 74*a* and 74*b* respectively, and a head portion 72 integrally connected to the proximal end 74*b* of shank portion 74. Head portion 72 has a discoid impact-receiving top surface 73 destined to receive mallet blows. Shank portion 74 is hollow and defines an inner longitudinal central cavity 76, and can for example be of rectangular cross-section to fit snugly yet slidably into cross-sectionally rectangular liner 36. Shank portion longitudinal cavity 76 is penetrated by stem member 40 that loosely fits centrally within shank portion longitudinal cavity 76, and plunger 70 is thus telescopically mounted on stem member 40. In the embodiment shown in the drawings, shank portion longitudinal cavity 76 is of rectangular cross-section, and defines an inner peripheral wall 81 thus having four longitudinally extending flat wall portions.

A blade groove 78 (FIG. 7) is made on one 77*a* of the four outer side walls 77 of plunger shank portion 74, and a roller groove 79 (FIG. 2) is made on the side wall 77*b* opposite side wall 77*a*. Roller groove 79 extends longitudinally along side wall 77*b* and defines rounded distal and proximal ends 79*a* and 79*b* that are located short of the plunger shank portion distal and proximal ends 74*a*, 74*b* respectively. Roller groove 79 is rollably engaged by a guide roller 80; roller 80 is housed in a relatively larger roller cavity 85 made in plunger socket 30, and is mounted to a gudgeon 82 fixedly yet releasably carried by and extending across the nailer's plunger socket 30 (see FIGS. 1 and 2) and held in position by a locking pin 83. This rollable engagement by roller 80 on the plunger's roller groove 79 serves to guide and limit the axial sliding motion of plunger 70 relative to liner 36 between limit positions defined herein after, as the roller groove distal and proximal ends 79*a*, 79*b* will abut against roller 80 in these limit positions.

An elongated replaceable hammer blade 84 (see FIGS. 2 and 8) is releasably friction fitted in blade groove 78, so as to be in parallel alignment with plunger shank portion 74 and so as to extend well beyond the shank portion distal end 74*a*. Hammer blade 84 is positioned so as to have one of its extremities register with and extend through blade opening 35. Shank portion distal end 74*a* may of course be equipped with any suitable alternate fastener driving member that is intended to extend into blade opening 35. Mounted around the shank portion proximal end 74*b* is a donut shock absorber and blade retainer 90, made of rubber for example. Since donut 90 is located between plunger head portion 72 and plunger socket 30, it prevents plunger head portion 72 from directly striking plunger socket 30 as the plunger head portion 72 is driven towards the free end of main body plunger socket 30 under a mallet blow. Also, since donut 90 is wrapped around the proximal end 74*b* of plunger shank portion 74 and the registering end portion of hammer blade 84, it retains hammer blade 84 within blade groove 78.

One flat wall portion 81*a* of the inner peripheral wall 81 of shank portion longitudinal cavity 76 comprises second ratchet means in the form of a number of teeth 92 formed thereon, with grooves 93 being formed between pairs of consecutive teeth 92. More particularly, grooves 93 are cut away directly into the shank cavity flat wall portion 81*a* so that each groove 93 is substantially straight and extends along flat wall portion 81*a* perpendicularly to the longitudinal axis of plunger 70. Each tooth 92 being formed between consecutive pairs of grooves 93, teeth 92 also extend along flat wall portion 81*a* perpendicularly to the longitudinal axis of plunger 70. Within liner 36, teeth and grooves 92 and 93 are in facing alignment with pawl tip 61, and grooves 93 are engageable by pawl tip 61 to prevent the return of the partially driven plunger 70, as detailed hereinafter. Moreover, a release clearance in the form of a release notch 96 is formed through the flat wall portion 81*a* of peripheral wall 81 of plunger shank portion 74 at a position intermediate teeth 92 and shank proximal end 74*b*.

A plunger biasing member in the form of a compressed coil spring 98 is nested within the inner cavity 76 of plunger shank portion 74. Coil spring 98 abuts at one end on the end of inner cavity 76 located at shank portion proximal end 74*b*, and at the opposite end on stem shoulder 45. Coil spring 98 is penetrated by stem spring post portion 44 and is for recoiling plunger head portion 72 away from plunger socket 30, as described hereinafter.

Plunger 70 is movable between two limit positions:

- a first extracted position (FIG. 3) where plunger shank portion 74 is partly extracted from socket member 30, plunger 70 is telescopically extended away from stem member 40, the inner wall 81 of shank portion 74 is located spacedly above and completely clears pawl 60, and guide roller 80 abuts against the rounded distal end 79*a* of roller groove 79 to prevent complete egress of plunger 70 from plunger socket 30; and
- a second retracted position (FIG. 5) where plunger shank portion 74 is fully inserted in socket member 30, plunger 70 is telescopically retracted towards stem member 40, donut 90 abuts against the upper free end of plunger socket 30, pawl tip 61 extends through release notch 96 made in plunger shank portion 74, and guide roller 80 abuts against rounded proximal end 79*b* of roller groove 79.

In use, nailer 10—with its plunger 70 in its extracted position—is positioned against the upper surface of a tongue-and-groove flooring workpiece W so that nose 23 of ejection cap 18 is placed above the tongue T of the workpiece. The user then forcibly strikes the impact-receiving surface 73 of plunger head portion 72 with a mallet M. This urges plunger 70 into a downstroke where it progressively retracts into liner 36, against the bias of coil spring 98, and concomitantly urges hammer blade 84 to move downwardly and sweep fastener ejection channel 20, in order to strike a fastener F positioned therein. The frangible attachment of fastener F to the adjacent fastener strip will yield to allow fastener F to be fully driven into the workpiece W and into the subfloor S by hammer blade 84 only when plunger 70 has reached its retracted limit position.

Figure 4:
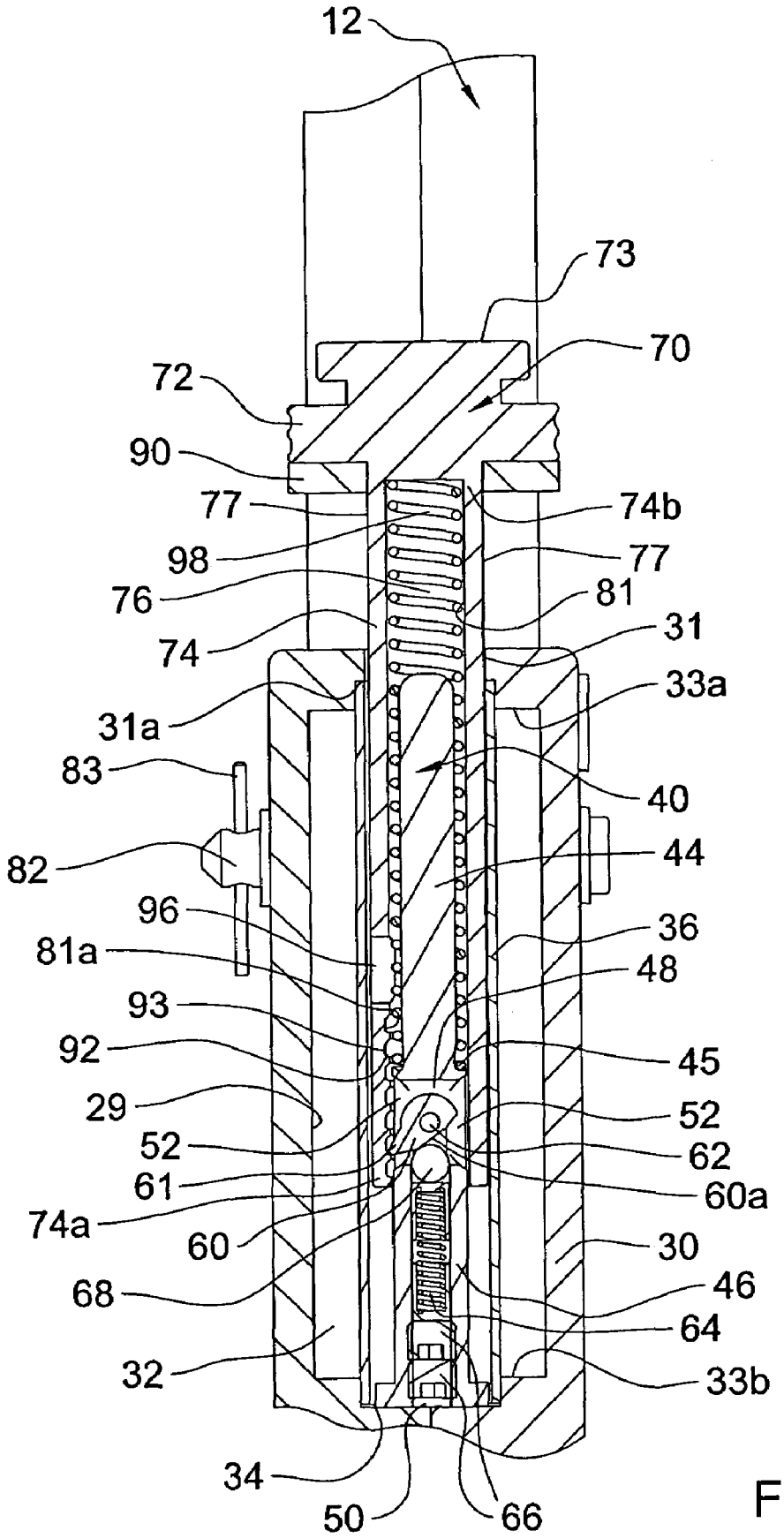

During this downstroke of plunger 70, plunger shank portion 74 retracts into liner 36 and plunger 70 telescopically retracts around stem member 40 towards stem foot member 42, and pawl tip 61 serially engages and slides over teeth 92 made on the inner wall of shank portion 74 and into the lateral grooves 93 formed therebetween. More particularly, during the downstroke of plunger 70 where plunger 70 moves from its extracted towards its retracted limit position, pawl tip 60 is pivoted downwardly in a downstroke position under the action of the downwardly moving distal end 74*a* of plunger shank portion 74, which engages and abuts against pawl tip 61. As shown in FIG. 4, pawl 60 will remain inclined in this downstroke position as plunger shank portion continues to move downwardly, with pawl tip 61 sequentially abutting against teeth 92 that prevent pawl 60 from reaching its neutral position. Indeed, it is recalled that the spring biased ball 68 continuously forces pawl 60 towards its neutral position, and thus pawl tip 61 will upwardly abut against teeth 92. It is noted that grooves 93 and teeth 92 are sized and disposed in such a manner to prevent pawl 60 from pivoting freely to its neutral position, i.e. whenever pawl tip 61 clears a given tooth 92, the serially subsequent tooth 92 intercepts pawl tip 61 before pawl 60 reaches its neutral position.

If plunger 70 is only partially driven into plunger socket 30 after a mallet blow, i.e. it has been urged downwardly but not sufficiently so as to have reached its retracted limit position, pawl tip 61, which is pivoted in its downstroke position, unidirectionally lockingly engages one of the teeth 92 to prevent plunger 70 from recoiling out of plunger socket 30 under the biasing influence of the compressed coil spring 98. The engagement of pawl 60 on a tooth 92 thus maintains plunger 70 in a static intermediate position between its extracted and retracted limit positions which prevents another fastener from loading into fastener ejection channel 20 since the latter is at least partially occupied by hammer blade 84 and by the upper extremity of the partly discharged fastener as shown in FIG. 8. The user can thus pound repeatedly on the plunger with his mallet to gradually move it to its retracted limit position, without the plunger recoiling back under the influence of coil spring 98 to its extracted limit position between each mallet blow. The user can thus drive the fastener into the subjacent workpiece W with a number of mallet blows that each move plunger 70 a fraction of the way towards its retracted limit position.

Figure 5:
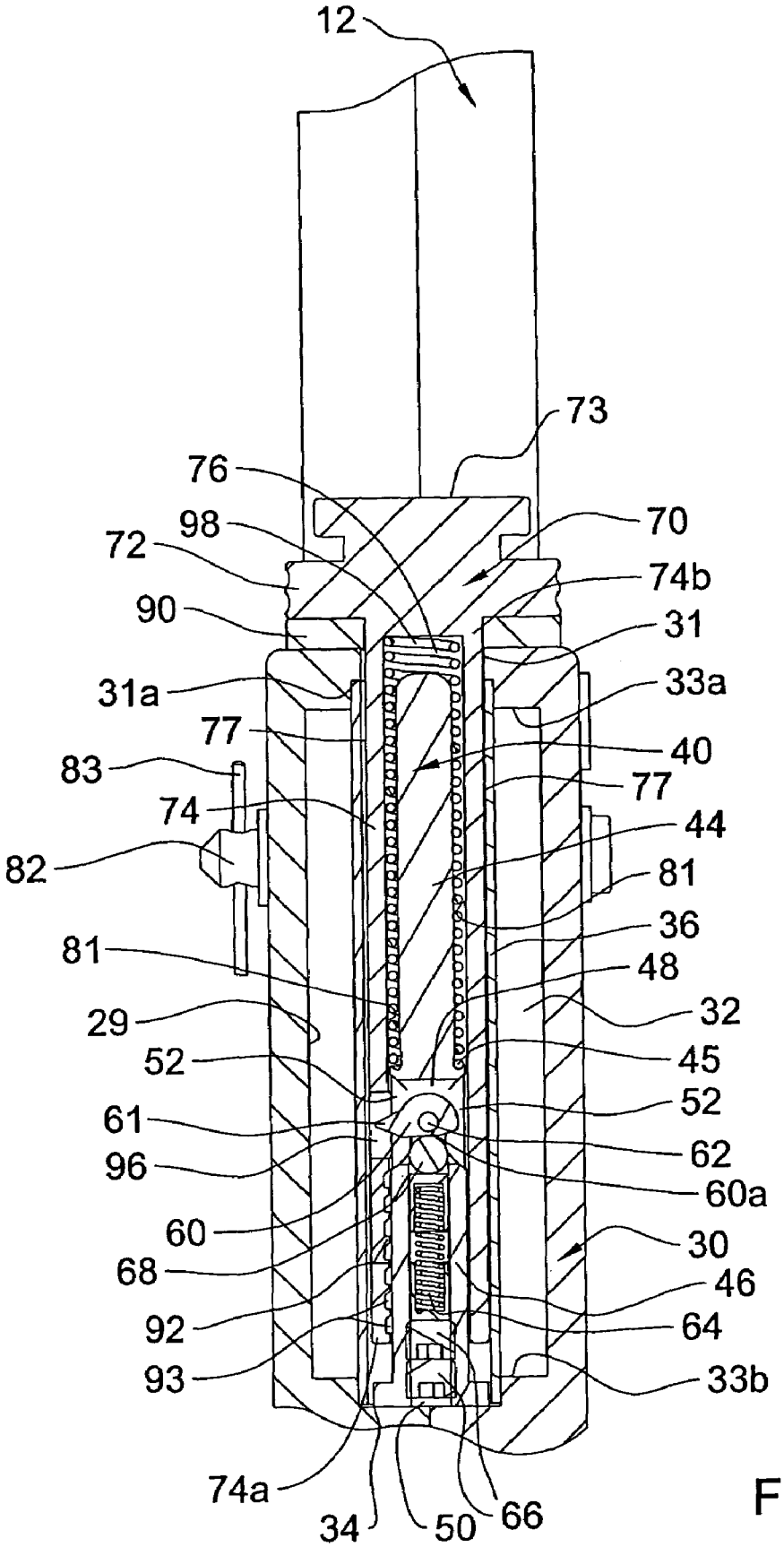

When plunger 70 reaches its retracted limit position, pawl tip 61 clears teeth 92 and enters the pawl release clearance formed by release notch 96 in plunger shank portion 74, where the spring member 64/ball 68 combination pivots pawl 60 about pivot pin 62 from its downstroke to its neutral position, as shown in FIG. 5. Indeed, release notch 96 is sized and configured to allow free and unhindering pivotal movement of pawl tip 61 therein.

Figure 6:
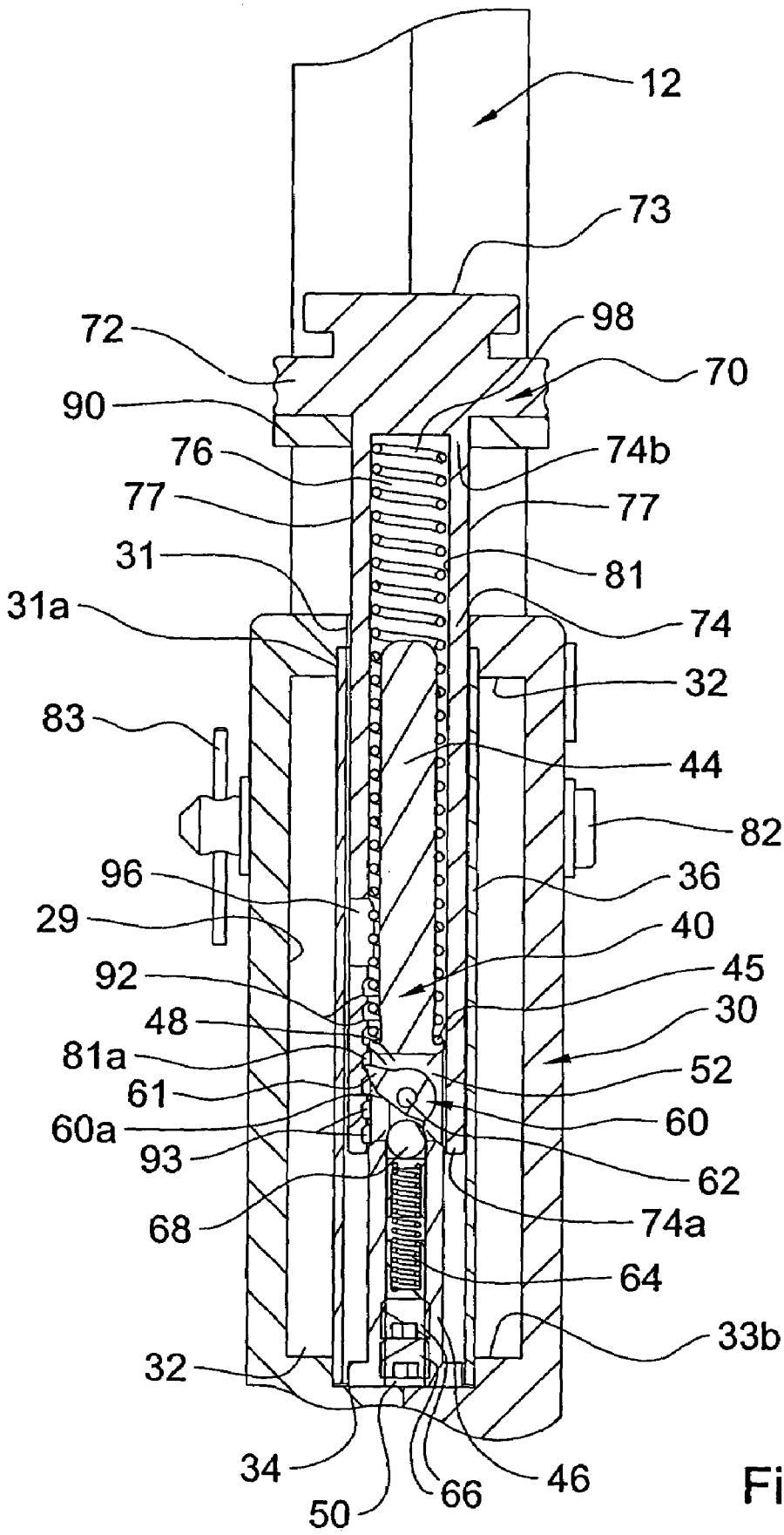

When pawl 60 is at this neutral position, coil spring 98 is allowed to decompress in order to recoil plunger 70 towards its extracted limit position without hindrance from pawl 60. Indeed, during the upstroke of plunger 70 where it moves under the bias of coil spring 98 from its retracted to its extracted limit position, pawl tip 61 will abut against the lower edge of release notch 96 and pawl 60 will pivot against the action of spring-biased ball 68 into an upstroke position (as illustrated in FIG. 6). As pawl tip 61 thereafter slides along the inner wall portion 81*a* of plunger shank 74, it will sequentially engage teeth 92 as shown in FIG. 6. Since teeth 92 and grooves 93 are sized and configured to force pawl tip 61 to engage another tooth 92 as it clears a previous tooth 92 as stated herein above, pawl 60 will remain upwardly inclined in this upstroke position and pawl tip 61 will not hinder the upward movement of plunger shank portion 74. However, plunger 70 cannot be moved again towards its retracted limit position until it has reached its extracted limit position and pawl tip 61 clears the plunger shank portion central cavity 76, since pawl tip 61 would then lock against one of teeth 92. This is desirable since plunger 70 must reach its extracted limit position for blade 84 to clear fastener ejection channel 20 and for another fastener F to be admitted in fastener ejection channel 20.

Figure 3:
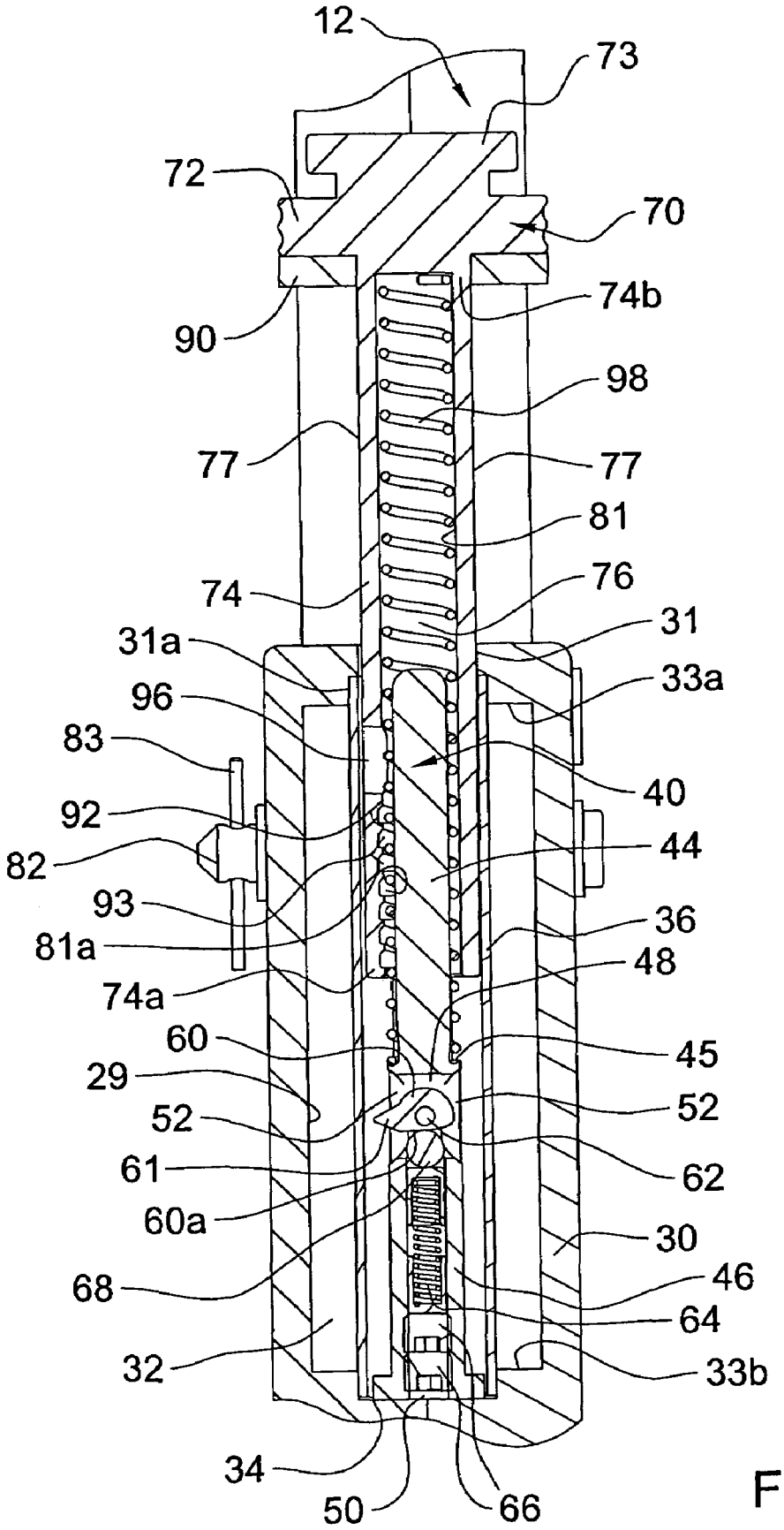
FIGS. 3-6 are enlarged front cross-sectional views of the plunger socket and its inner content, sequentially showing the movement of the plunger between its extracted and retracted positions and showing the various configurations of the ratchet mechanism lodged therein during the movement of the plunger.

Once plunger 70 reaches its extracted limit position, pawl tip 61 clears the plunger shank central cavity 76 and is free to pivot to its neutral position as shown in FIG. 3. It can thus be said that the gap formed beyond plunger shank portion lower end 74*b* is a pawl release clearance of the same nature as release notch 96, i.e. allowing pawl 60 to return from a pivoted position to its neutral position under the influence of spring-biased ball 68. Another fastener can then load into fastener ejection channel 20, and nailer 10 may be used again to drive this new fastener out of nailer 10 with a single or multiple mallet blows.

One important advantage of the present nailer is the fact that all the interacting ratchet components are contained within plunger mechanism 17, and more particularly within plunger cavity 76 and the stem sleeve 46. Plunger 70 and stem sleeve 46 being made from very rigid materials, they are not prone to deformation during use of the nailer; consequently, alignment between the teeth and grooves made on plunger 70 and pawl 60 carried by stem 40 are likely to remain properly aligned after repeated use and ageing of the nailer.

In prior art nailers, some of the ratchet components are carried directly by the nailer's main body, which is typically made of aluminium—a material that is relatively soft and likely to bend and deform after repeated use of the nailer. Accordingly, as use of the nailer goes on, its main body progressively locally bends and deforms, the pawl and the teeth/grooves hence eventually become misaligned, and the ratchet mechanism thus ceases to function properly. This problem is obviated in the present invention by providing all elements of the ratchet mechanism on the plunger and stem, which are typically made of very sturdy and bend-resistant materials.

Moreover, the ratchet-provided plunger of the present invention can be retrofitted on existing manual nailers that do not include any ratchet mechanism. A kit comprising the hollow plunger with teeth and grooves made on its inner surface, the stem provided with a spring-loaded pawl, the coil spring destined to be compressed between the stem and the plunger, and the hammer blade, could be sold as a retrofittable kit for installation on an existing nailer having a plunger socket of compatible dimensions and configuration. This retrofit installation is possible since the nailer's main body need not be modified to accommodate any element of the ratchet mechanism, since the ratchet mechanism parts operate from within the longitudinal cavity of the plunger shank portion. Moreover, the attachment of the ratchet mechanism to nailer body 12 is obtained through the instrumentality of guide roller 80 that prevents plunger 70 from complete axial egress out of the socket member cavity 32 due to the abutment of the plunger roller groove distal end 79*a* on guide roller 80. Stem member 40 is maintained in position simply under the bias of coil spring 98, that is compressed between the stem member 45 and plunger head 72, stem member 40 thus being continuously biased towards and resting against the socket cavity bottom wall recess 33*b*.

To install a ratchet-provided plunger mechanism according to the present invention on an existing nailer, locking pin 83 (see FIGS. 1 and 3-6) retaining roller gudgeon 82 on plunger socket 30 is removed, and roller gudgeon 82 is in turn removed from plunger socket 30. This causes roller 80 to be freely released inside the relatively larger roller cavity 85, and causes it to be allowed to clear the roller guiding groove made on the side of a plunger previously installed inside plunger socket 30. This allows removal of any previously installed plunger mechanism out of plunger socket 30 and this plunger mechanism removal procedure is known in the art. The ratchet-provided plunger/stem/coil spring kit of the present invention can then be inserted in plunger socket 30, within liner 36. This insertion is accomplished by simply sliding the plunger and stem assembly into socket 30, with stem foot 92 coming to bear against the bottom wall 34 of plunger socket cavity 32. Plunger 70 is then partly moved towards its retracted position until roller groove 79 registers with roller 80. Plunger 70 is then maintained in this position, while gudgeon 82 is reinserted across plunger socket 30 and through guiding roller 80, and locking pin 83 is reinserted through the pierced outer free end of gudgeon 82 protruding outwardly of plunger socket 30. This allows the removal of prior art non-ratchet-provided mechanisms from nailers, to replace them with a ratchet-provided plunger mechanism including a plunger 70 and a stem member 40, without any further modification to the nailer body 12.

It is understood that the above-described embodiment of the present invention is exemplary, and that modifications could be made thereto without departing from the scope of the appended claims. For example:

- the position of cooperating first and second ratchet means could be inverted. For example, in an alternate embodiment, the pawl could be carried by the plunger and the teeth and grooves could be made on the stem; what matters is that the first and second ratchet means be capable of unidirectional releasable interlocking engagement;
- the spring member and ball assembly biasing the pawl in a given pivotal direction could be replaced with any suitable resilient biasing member;
- coil spring 98 could be replaced by any alternate biasing member. It is noted that coil spring 98 could rest against nailer main body 12 instead of against stem member 40, as long as it acts on plunger 70; and
- liner 36, plunger socket 30 and plunger shank portion 74 could be have any suitable cross-sectional shape, such as a round cross-sectional shape.

The invention claimed is:

1. A nailer for driving a fastener into a workpiece, comprising:

- a main body defining a fastener ejection channel for accommodating a fastener;
- a plunger movably carried by said main body and defining a first end for receiving forceful blows and a second end for engaging the fastener, said plunger carrying first ratchet means, said plunger defining a longitudinal cavity extending from said first end towards said second end, said plunger being movable relative to said main body between a first position in which said plunger second end clears said fastener ejection channel, and a second position in which said plunger second end engages said fastener ejection channel for ejecting the fastener from said nailer;
- a stem member carried by said main body, said stem member penetrating said plunger longitudinal cavity, said stem member carrying second ratchet means capable of unidirectional releasable interlocking engagement with said first ratchet means; and
- a plunger biasing member continuously biasing said plunger towards said first position;

wherein upon a forceful blow being applied to said plunger first end, said plunger will be forced from said first towards said second positions and wherein if said plunger is forced to an intermediate position between said first and said second positions, said first and second ratchet means will cooperate in unidirectional releasable interlocking fashion to retain said plunger in said intermediate position against the bias of said plunger biasing member whereby said plunger may be gradually moved with several forceful blows from said first to said second position without moving back towards its first position until it reaches said second position.

2. The nailer according to claim 1, wherein said first ratchet means comprises sets of alternating teeth and grooves made on a peripheral wall of said plunger longitudinal cavity, and said second ratchet means is a spring-loaded pawl pivotally mounted to said stem member and having a pawl tip lockingly engageable in said grooves.

3. The nailer according to claim 2, wherein said stein member comprises a lumen in which an elongated pawl spring and a ball are is coaxially nested, said pawl spring continuously biasing said ball towards said pawl in order for said pawl to be continuously biased towards a neutral position.

4. The nailer according to claim 2, wherein said pawl is pivoted to a first pawl position when said plunger is moved from said first position to said second position arid is located therebetween, wherein when said pawl is in said first pawl position, said pawl will cooperate with said teeth and said grooves in unidirectional releasable interlocking engagement to prevent said plunger to move towards said first position; and wherein said plunger cavity peripheral wall comprises a first release clearance registering with said pawl tip when said plunger is in said second position, such that said pawl tip can partially extend into said first release clearance when said plunger is in said second position so as return from said first pawl position to a neutral position, to allow said plunger biasing member to urge said plunger towards said first position without hindrance from said pawl when said plunger reaches said second position.

5. The nailer according to claim 4, wherein said first release clearance is a release notch made through said plunger cavity peripheral wall at a position intermediate said set of teeth and said plunger first end.

6. The nailer according to claim 4, wherein said pawl is pivoted to a second pawl position when said plunger is moved from said second position to said first position and is located therebetween, wherein when said pawl is in said second pawl position, said pawl will cooperate with said teeth and grooves in unidirectional releasable interlocking engagement to prevent said plunger to move towards said second position; and wherein said plunger cavity peripheral wall comprises a second release clearance registering with said pawl tip when said plunger is in said first position, such that said pawl tip partially extends into said second release clearance when said plunger is in said second position so as return from said second pawl position to said neutral position, to allow said plunger to be urged towards said second position without hindrance from said pawl when said plunger is in said first position.

7. The nailer according to claim 6, wherein said second release clearance is a gap formed beyond said plunger second end.

8. The nailer according to claim 1, wherein said main body comprises an elongated plunger socket defining top and bottom walls and an elongated peripheral wall extending therebetween, said plunger socket having an opening at said top wall thereof; said plunger socket comprising a tubular liner extending from said socket bottom wall to said top wail about said socket opening, said plunger being slidably received in said liner, and said stem member being located within said liner and resting against said socket bottom wall.

9. The nailer according to claim 1, wherein said main body further comprises a guide roller attached to said plunger socket and rollably engaging a guiding groove made on an outer surface of said plunger.

10. The nailer according to claim 1, wherein said plunger further comprises a hammer blade at said second end, said hammer blade positioned so as to sweep said fastener ejection channel when said plunger is moved Cram said first to said second positions.

11. The nailer according to claim 1, wherein said plunger biasing member is a spring linked to said plunger and said stem member.

12. A ratchet-provided plunger mechanism for installation on a nailer, comprising:

a plunger for movable attachment to the nailer main body and defining a first end for receiving forceful blows and a second end for engaging a fastener to be discharged by the nailer, said plunger carrying first ratchet means, said plunger defining a longitudinal cavity extending from said first end and towards said second end;

a stem member for installation on a main body of the nailer, said stem member carrying second ratchet means, wherein said second ratchet means are capable of unidirectional releasable interlocking engagement with said first ratchet means, said stem member penetrating said plunger longitudinal cavity, said plunger being telescopically movable relative to said stem member between a first position in which said plunger is telescopically extended away from said stem member for said plunger second end to clear a fastener ejection channel of the nailer main body, and a second position in which said plunger is telescopically retracted towards said stem member for said plunger second end to engage the fastener ejection channel; and a plunger biasing member for continuously biasing said plunger towards said first position;

wherein upon a forceful blow being applied to said plunger first end, said plunger will be forced from said first towards said second positions and wherein if said plunger is forced to an intermediate position between said first and said second positions, said first and second ratchet means will cooperate in unidirectional releasable interlocking fashion to retain said plunger in said intermediate position against the bias of said plunger biasing member, whereby said plunger may be gradually moved with several forceful blows from said first to said second position without moving back towards its first position until it reaches said second position.

13. The ratchet-provided plunger mechanism according to claim 12, wherein said plunger comprises a guiding groove made on an outer surface thereof for engagement by a guide roller carried by the nailer main body.

14. The ratchet-provided plunger mechanism according to claim 12, wherein said plunger further comprises a hammer blade at said second end, said hammer blade being for sweeping the fastener ejection channel of the nailer main body when said plunger is moved from said first to said second positions.

15. A ratchet-provided plunger mechanism for installation on a nailer, comprising:

a plunger for movable attachment to the nailer main body and defining a first end for receiving forceful blows and a second end for engaging a fastener to be discharged by the nailer, said plunger carrying first ratchet means, said plunger defining p longitudinal cavity extending from said first end and towards said second end:

a stem member for installation on a main body of the nailer, said stem member carrying second ratchet means, wherein said second ratchet means are capable of unidirectional releasable interlocking engagement with said first ratchet means, said stern member penetrating said plunger longitudinal cavity, said plunger being telescopically movable relative to said stem member between a first position in which said plunger is telescopically extended away from said stem member for said plunger second end to clear a fastener ejection channel of the nailer main body, and a second position in which said plunger is telescopically retracted towards said stem member for said plunger second end to engage the fastener ejection channel; and a plunger biasing member for continuously biasing said plunger towards said first position;

wherein upon a forceful blow being applied to said plunger first end, said plunger will be forced from said first towards said second positions and wherein if said plunger is forced to an intermediate position between said first and said second positions, said first and second ratchet means will cooperate in unidirectional releasable interlocking fashion to retain said plunger in said intermediate position against the bias of said plunger biasing member whereby said plunger may be gradually moved with several forceful blows from said first to said second position without moving back towards its first position until it reaches said second position; and wherein said first ratchet means comprises sets of alternating teeth and grooves made on a peripheral wall of said plunger longitudinal cavity, and said second ratchet means is a spring-loaded pawl pivotally mounted to said stem member and having a pawl tip lockingly engageable in said grooves.

16. The ratchet-provided plunger mechanism according to claim 15, wherein said stern member comprises a lumen in which an elongated pawl spring and a ball are coaxially nested, said pawl spring continuously biasing said ball towards said pawl in order for said pawl to be continuously biased towards a neutral position.

17. The ratchet-provided plunger mechanism according to claim 15, wherein said pawl is pivoted to a first pawl position when said plunger is moved from said first position to said second position and is located therebetween, wherein when said pawl is in said first pawl position, said pawl will cooperate with said teeth and said grooves in unidirectional releasable interlocking engagement to prevent said plunger to move towards said first position; and wherein said plunger cavity peripheral wall comprises a first release clearance registering with said pawl tip when said plunger is in said second position, such that said pawl tip can partially extend into said first release clearance when said plunger is in said second position so as return from said first pawl position to a neutral position, to allow said plunger biasing member to urge said plunger towards said first position without hindrance from said pawl when said plunger reaches said second position.

18. The ratchet-provided plunger mechanism according to claim 17, wherein said first release clearance is a release notch made through said plunger cavity peripheral wall at a position intermediate said set of teeth and said plunger first end.

19. The ratchet-provided plunger mechanism according to claim 17, wherein said pawl is pivoted to a second pawl position when said plunger is moved from said second position to said first position and is located therebetween, wherein when said pawl is in said second pawl position, said pawl will cooperate with said teeth and grooves in unidirectional releasable interlocking engagement to prevent said plunger to move towards said second position; and wherein said plunger cavity peripheral wall comprises a second release clearance registering with said pawl tip when said plunger is in said first position, such that said pawl tip partially extends into said second release clearance when said plunger is in said second position so as return from said second pawl position to said neutral position, to allow said plunger to be urged towards said second position without hindrance from said pawl when said plunger is in said first position.

20. The ratchet-provided plunger mechanism according to claim 19, wherein said second release clearance is a gap formed beyond said plunger second end.

* * * * *